US012643054B2

(12) United States Patent
Yale et al.

(10) Patent No.: US 12,643,054 B2
(45) Date of Patent: Jun. 2, 2026

(54) APPARATUS AND METHOD FOR LOCKING AND UNLOCKING A POINTING DEVICE MOUNTED ON A CAR OF AN AMUSEMENT PARK RIDE

(71) Applicant: Triotech Amusement Inc., Montreal (CA)

(72) Inventors: Ernest Yale, L'Île-Cadieux (CA); Jean-François D'Arrisso, Montréal (CA); Pierre Cyr, Lachine (CA); Guillaume Bourbeau, Montréal (CA); Andrei Culuri, Verdun (CA); Renaud Varin, Terrebonne (CA)

(73) Assignee: Triotech Amusement Inc., Montreal (CA)

( * ) Notice: Subject to any disclaimer, the term of this patent is extended or adjusted under 35 U.S.C. 154(b) by 341 days.

(21) Appl. No.: 18/491,144

(22) Filed: Oct. 20, 2023

(65) Prior Publication Data

US 2024/0131441 A1 Apr. 25, 2024
US 2024/0226761 A9 Jul. 11, 2024

Related U.S. Application Data

(60) Provisional application No. 63/418,061, filed on Oct. 21, 2022.

(51) Int. Cl.
*A63G 33/00* (2006.01)

(52) U.S. Cl.
CPC ..... *A63G 33/00* (2013.01)

(58) Field of Classification Search
CPC ..... A63G 33/00
See application file for complete search history.

(56) References Cited

U.S. PATENT DOCUMENTS 4,795,118 A 1/1989 Kosugi et al.
7,549,798 B2 6/2009 Watanabe
(Continued)

FOREIGN PATENT DOCUMENTS

EP 2381331 A1 10/2011
GB 618296 A 2/1949
(Continued)

OTHER PUBLICATIONS

International Search Report and Written Opinion mailed Dec. 4, 2023, in International Application No. PCT/CA2023/051393 (8 pages).

*Primary Examiner* — Nathan J Flynn
(74) *Attorney, Agent, or Firm* — Bookoff McAndrews, PLLC

(57) ABSTRACT

A pointer for mounting on an amusement park ride, the pointer having a grip adapted to be held by at least one hand of a user, a grip detection device integrated into the grip for detecting when the grip is held by the user, and a pivot unit pivotably coupling the grip to the amusement park ride, the pivot unit operable between an uninhibited state, in which the pivot unit permits the grip to freely pivot in at least a first direction and a second direction, and an inhibited state, in which the pivot unit inhibits the grip from pivoting in at least the second direction, wherein the pivot unit may transition to the uninhibited state when the grip detection device detects the grip is held by the user and the pivot unit may return to the inhibited state when the grip detection device detects the grip is released.

33 Claims, 8 Drawing Sheets

(56) References Cited

U.S. PATENT DOCUMENTS

| | | | | |
|---|---|---|---|---|
| 7,588,377 | B2 | 9/2009 | Speggiorin | |
| 2004/0011154 | A1 | 1/2004 | Dybro | |
| 2020/0306653 | A1* | 10/2020 | Daniel | A63G 33/00 |
| 2022/0083132 | A1 | 3/2022 | Hare et al. | |

FOREIGN PATENT DOCUMENTS

| | | | |
|---|---|---|---|
| JP | 60-189793 | * | 12/1985 |
| JP | 4215680 | B2 | 1/2009 |
| KR | 10-2011-0119901 | A1 | 11/2011 |

* cited by examiner

APPARATUS AND METHOD FOR LOCKING AND UNLOCKING A POINTING DEVICE MOUNTED ON A CAR OF AN AMUSEMENT PARK RIDE

FIELD OF THE INVENTION

This disclosure relates generally to the field of amusement park rides and, in particular, amusement park rides with interactive devices mounted thereon.

INTRODUCTION

The modern amusement park may be considered to have roots several centuries old, dating back to the "pleasure gardens" of the $18^{th}$ century. While these early incarnations focused on spectacles for the eyes such as fortune tellers, magicians, musicians, acrobats, and artists, amusement parks have evolved over time to create an increasingly interactive and immersive experience for park-goers. Modern amusement parks offer a plethora of rides utilizing 4D technology to combine physical effects such as the motion of the ride, lights, mist, and air cannons, with visual presentations of motion pictures which, in combination, can transport the rider to another world. As ride designers continue to push the bounds of physics to bring new interactive and immersive experiences, safety measures for the riders likewise continue to evolve.

SUMMARY OF THE VARIOUS EMBODIMENTS

In accordance with one aspect of this disclosure, there is provided a pointer for mounting on an amusement park ride, the pointer comprising:

a grip adapted to be held by at least one hand of a user;

a grip detection device integrated into the grip, the grip detection device for detecting when the grip is held by the user; and a pivot unit pivotably coupling the grip to at least one portion of the amusement park ride, the pivot unit operable between an uninhibited state, in which the pivot unit permits the grip to freely pivot in at least a first direction and a second direction, and an inhibited state, in which the pivot unit inhibits the grip from pivoting in at least the second direction;

wherein the pivot unit may transition to the uninhibited state when the grip detection device detects the grip is held by the user; and wherein the pivot unit may return to the inhibited state when the grip detection device detects the grip is released.

In any embodiment, the first direction may be away from the user and the second direction may be toward the user.

In any embodiment, the grip may comprise at least one first engagement member coupled to the grip proximate the pivot unit, and the pivot unit may include at least one second engagement member movably coupled to the pivot unit, the at least one second engagement member for engaging the at least one first engagement member;

wherein when the at least one second engagement member is engaged with the at least one first engagement member, the pivot unit may be in the inhibited state; and wherein when the at least one second engagement member is disengaged from the at least one first engagement member, the pivot unit may in the uninhibited state.

In any embodiment, the grip may further comprise an arm extending from a first end to a second end, the first end extending from the grip, the second end being pivotably coupled to the at least one portion of the amusement park ride via the pivot unit;

wherein the second end of the arm may comprise the at least one first engagement member.

In any embodiment, the pivot unit may further comprise at least one biasing means coupled to the at least one second engagement member, the biasing means biasing the at least one second engagement member toward the at least one first engagement member.

In any embodiment, the pivot unit may further comprise at least one linear drive device coupled to the at least one second engagement member, the at least one linear drive device being operable to move the at least one second engagement member to disengage from the at least one first engagement member.

In any embodiment, the at least one first engagement member may comprise at least two first engagement members, and the at least one second engagement member may comprise at least two second engagement members.

In any embodiment, the at least one biasing means may comprise at least two biasing means, and the at least one linear drive device may comprise at least two linear drive devices.

In any embodiment, each first engagement member may be a ratchet and each second engagement member may be a pawl.

In any embodiment, each biasing means may be a spring.

In any embodiment, each linear drive device may be a solenoid.

In any embodiment, the pointer may further comprise a processor in communication with the grip detection device and the pivot unit, the processor may be configured to:

operate the pivot unit to transition to the uninhibited state when the grip detection device detects the grip is held by the user; and operate the pivot unit to return to the inhibited state when the grip detection device detects the grip is released.

In any embodiment, operating the pivot unit to transition to the uninhibited state may comprise activating the at least one linear drive device to move the at least one second engagement member to disengage from the at least one first engagement member; and operating the pivot unit to return to the inhibited state may comprise deactivating the at least one linear drive device such that the at least one biasing means returns the at least one second engagement member into engagement with the at least one first engagement member.

In any embodiment, the grip detection device may comprise a depressible member, and the grip detection device may detect the grip is held by the user when the depressible member is depressed by the hand of the user.

In any embodiment, the depressible member may be a button.

In any embodiment, the depressible member may be a switch.

In any embodiment, the grip detection device may comprise a touch sensor, and the grip detection device may detect the grip is held by the user when the hand of the user contacts the touch sensor.

In any embodiment, the grip may be pivotable between a lower position in the first direction and an upper position in the second direction.

In any embodiment, when the at least one second engagement member is engaged with the at least one first engagement member and the grip is in the lower position, the pointer may be inhibited from moving.

In any embodiment, the at least one portion of the amusement park ride may comprise a safety bar, and the grip may be pivotably coupled to the safety bar via the pivot restriction unit such that the grip may be positioned in front of the user when seated on the amusement park ride.

In any embodiment, the upper position may be 30 degrees rotationally in the second direction from a longitudinal axis of the pivot unit.

In any embodiment, the lower position may be 30 degrees rotationally in the first direction from the longitudinal axis of the pivot unit.

In any embodiment, the grip may further comprise a ball joint pivotably coupling the grip to the pivot unit, the ball joint may permit the grip to pivot in at least a third direction and a fourth direction, the ball joint may further permit the grip to rotate about the ball joint in a clockwise direction and a counter-clockwise direction.

In any embodiment, the pivot unit may further include a lateral stop coupled to the pivot unit proximate the ball joint, and the lateral stop may have a recessed portion shaped to receive the grip when the grip is in the lower position;

wherein when the grip is received in the recessed portion, the grip may be inhibited from pivoting in the third direction and the fourth direction.

In any embodiment, the recessed portion of the lateral stop may further be shaped to guide the grip to be centered in front of the user when moving to the lower position.

In any embodiment, the grip may further include a rotational stop coupled to the grip proximate the ball joint and the pivot unit may further include a stop member proximate the ball joint, and the rotational stop may be shaped to engage the stop member when the grip is in the lower position;

wherein when the rotational stop is engaged with the stop member, the grip may be inhibited from rotating about the ball joint in the clockwise direction and the counter-clockwise direction.

In any embodiment, the pointer may further comprise a jaw coupled to the at least one first engagement member, the jaw surrounding the ball joint such that the jaw may move with the grip when pivoting in the first direction and the second direction.

In any embodiment, the jaw may further comprise a lateral slot and the grip may extend through the lateral slot, the lateral slot defining a boundary within which the grip is pivotable in the third direction and the fourth direction.

In any embodiment, the boundary of the lateral slot may permit the grip to pivot up to 30 degrees in the third direction and up to 30 degrees in the fourth direction, the third direction being leftward from the longitudinal axis of the pivot unit, the fourth direction being rightward from the longitudinal axis of the pivot unit.

In any embodiment, the lateral slot may define a rotational boundary within which the grip may be rotatable about the ball joint.

In any embodiment, the rotational boundary may permit the grip to rotate up to 12 degrees in a clockwise direction and up to 12 degrees in a counter-clockwise direction about the ball joint.

In any embodiment, the grip may be biased in the first direction toward the lower position such that the grip moves in the first direction to the lower position when released by the user.

In any embodiment, the grip may be balanced such that the grip falls in the first direction to the lower position when released by the user.

In accordance with one aspect of this disclosure, there is provided a pointer for mounting on an amusement park ride, the pointer comprising:

a grip adapted to be held by at least one hand of a user, the grip being adapted to be coupled to at least a portion of the amusement park ride;

a grip detection device integrated into the grip, the grip detection device for detecting when the grip is held by the user; and a pivot unit located between the grip and the at least one portion of the amusement park ride, the pivot unit permitting the user to freely pivot the grip about at least one axis when the grip detection device detects the grip is held by the user;

wherein the pivot unit is further adapted to bias the grip away from the user and to prevent pivoting of the grip when the grip detection device is released.

BRIEF DESCRIPTION OF THE DRAWINGS

For a better understanding of the described embodiments and to show more clearly how they may be carried into effect, reference will now be made, by way of example, to the accompanying drawings in which.

Figure 1:
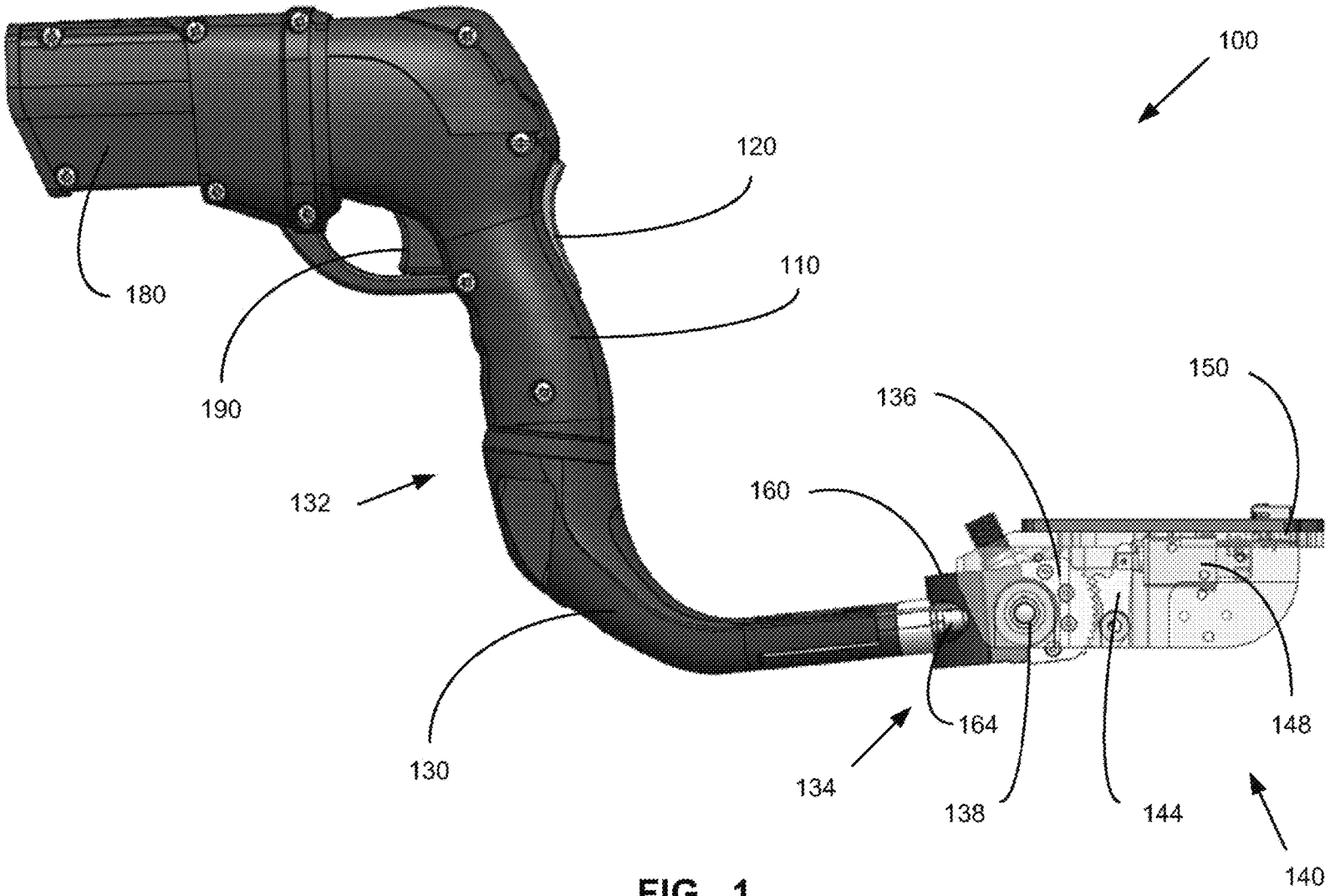
FIG. 1 is a side view of a pointer for mounting on an amusement park ride.

The drawings included herewith are for illustrating various examples of articles, methods, and apparatuses of the teaching of the present specification and are not intended to limit the scope of what is taught in any way.

The drawings may illustrate various examples of articles, methods, and apparatuses of the teaching of the present specification with translucent, transparent, or omitted features or elements for ease of reference to other features or elements that may be otherwise blocked or obscured from view, and are not intended to limit the scope of what is taught in any way.

DESCRIPTION OF VARIOUS EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

In order to continue the trend toward more interactive and immersive experiences for amusement park-goers, interactive accessories may be included into rider carriages or carts. However, such accessories may be loose or tethered to the cart, and thus may present a safety hazard for riders, risk damage to the ride itself, and may limit the maximum speed and mobility possible for such rides in view of these risks.

For example, without a limited range of motion, users may extend themselves and/or the accessory beyond the bounds of the cart, risking harm to themselves and others, as well as risking damage to the accessory and the ride.

Further, a loose or tethered accessory may present heightened risks corresponding to the speed and maneuverability of the ride. For example, due to the principles of inertia and gravity, such accessories may by flung from the cart during a sharp turn, corkscrew, loop-the-loop, rapid descent, or other form of extreme, rapid movement commonly conducted by an amusement park ride. Furthermore, in response to the above-described movements of a typical amusement park ride, riders often raise and/or waive their hands or, in extreme cases, lose consciousness. Accordingly, riders cannot be relied upon to maintain control of the accessories throughout the duration of the ride.

Ride Accessory with Safety Blocking System

For ease of reference, where possible, like numbering has been used to denote like exemplary features throughout the figures.

Referring to FIG. 1, shown therein is an example ride accessory, a pointer 100, according to an aspect of this disclosure. The pointer 100 may, for example, be a laser pointer, water gun, compressed air gun, or any other form of user-directed pointer conducive to a safe and interactive ride experience. For example, the pointer 100 may be a laser pointer for use by the rider to "shoot" targets along the track route of the ride.

The pointer 100 may be mounted to at least a portion of an amusement park ride, such as an individual cart or safety bar. For example, as shown in the in FIG. 6, the pointer 100 may be mounted to a "lap bar" type safety bar 300. In the embodiment shown, the pointer 100 is pivotably mounted to a padded bar 310 for securing the legs and/or buttocks of the user to a seat of the cart.

Referring again to FIG. 1, the pointer 100 has a grip 110 adapted to be held by at least one hand of a user. The grip 110 may resemble that of a single-handed firearm (e.g., a "pistol grip" type), a double-handed firearm (e.g., a "handle and grip" type), a handlebar-type grip (e.g., horizontal, U-shaped, etc.), or any other configuration suitable for a user to grasp and direct the pointer 100.

The grip 110 of the pointer 100 includes a grip detection device 120 integrated into the grip 110, the grip detection device 120 for detecting when the grip 110 is held by the user. The grip detection device 120 may be of any form suitable to detecting when the user has grasped the grip 110 and assumed control of the pointer 100. For example, the grip detection device 120 may be a depressible member, and the grip detection device 120 may detect the grip 110 is held by the user when the depressible member is depressed by the hand of the user. In any embodiment, the depressible member may be a button. In any embodiment, the depressible member may be a switch. In either such embodiments, the grip detection device 120 may by biased toward an undepressed position such that, upon releasing the grip 110, the grip detection device 120 returns to an undepressed state. In the embodiment shown in FIG. 1, the grip detection device 120 is a tab or switch in an undepressed state.

In any embodiment, the grip detection device 120 may be a touch sensor. In such embodiments, the grip detection device 120 may detect the grip is held by the user when the hand of the user contacts the touch sensor. For example, the touch sensor may detect body heat emitted from the hand or pressure applied by the hand when grasping the grip 110 of the pointer 100.

Figure 6:
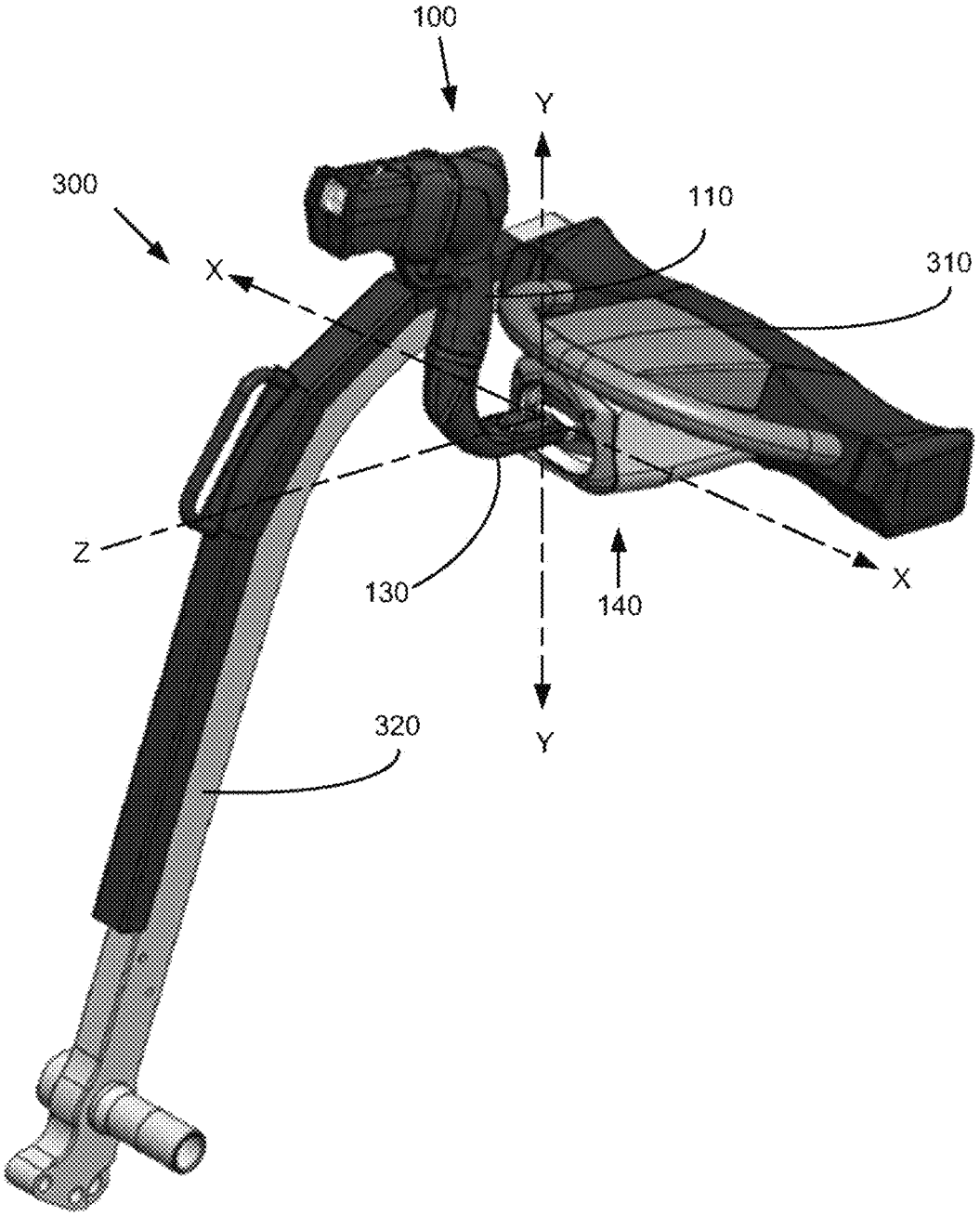
FIG. 6 is a front perspective view of the pointer of FIG. 1 mounted to a safety bar of an amusement park ride.

The pointer 100 may include a pivot unit 140 for pivotably coupling the grip 110 to at least one portion of the amusement park ride. In some embodiments, the pivot unit 140 may be externally mounted on the at least one portion of the amusement park ride such as, for example, on the padded bar 310 of safety bar 300 as shown in FIG. 6. In some embodiments, the pivot unit 140 may be integrally formed within the at least one portion of the amusement park ride. In such embodiments, the elements of the pivot unit 140 as described herein below may be contained within the at least one portion of the amusement park ride such that no pivot unit 140 is visible such as, for example, within the padded bar 310 of the safety bar 300 shown in FIG. 6. In either such embodiments, the grip 110 may be pivotably coupled to the safety bar 300 in a central location such that the grip 110 may be positioned in front of the user and easily accessible to the user when seated on the amusement park ride.

Referring again to the exemplary embodiment shown in FIG. 1, the pivot unit 140 is operable between an uninhibited state, in which the pivot unit 140 permits the grip 110 to freely pivot in at least a first direction and a second direction, and an inhibited state, in which the pivot unit 140 inhibits the grip 110 from pivoting in at least the second direction. In any embodiment, the first direction may be away from the user and the second direction may be toward the user. That is, in the inhibited state, the pivot unit 140 may prevent the grip 110 from pivoting uncontrolled toward the user.

The pivot unit 140 may transition to the uninhibited state when the grip detection device 120 detects the grip 110 is held by the user. Similarly, the pivot unit 140 may return to the inhibited state when the grip detection device 120 detects the grip 110 is released. The pivot unit 140 may remain in the inhibited state until the grip detection device 120 detects the grip 110 is held by the user. Accordingly, the grip 110 may freely pivot toward the user when the grip detection device 120 detects the grip 110 is held by, and thus controlled by, the user.

Referring still to FIG. 1, the grip 110 includes an arm 130 extending from a first end 132 to a second end 134, the first end 132 being coupled to the grip 110. The second end 134 of the arm 130 is pivotably coupled to the pivot unit 140. In embodiments where no arm 130 is used, the grip 110 may similarly be pivotably coupled to the pivot unit 140. In such embodiments, the grip 110 may be mounted to the at least one portion of the amusement park ride without an intervening arm 130, while performing the same role of the arm 130. In such embodiments, the grip 110 may be elongated in lieu of an arm 130. In such embodiments, the arm 130 or the grip 110 may be straight or curved, such as curved about 90-degrees, for example, as required to provide a suitable distance from the user and/or range of motion.

In the embodiment shown, the arm 130 extends from the grip 110 in a longitudinal direction of the grip 110. Other configurations are possible. For example, the arm 130 may intersect with the grip in a "T" or "L" shape, such as when the grip 110 is in a handlebar configuration. As another example, no arm 130 may be used as discussed above.

In any embodiment, the grip 110 may comprise at least one first engagement member 136 coupled to the grip 110 proximate the pivot unit 140. The grip 110 may be pivotably coupled to the pivot unit 140 via the at least one first engagement member 136, and the pivot unit 140 may include at least one second engagement member 144 movably coupled to the pivot unit 140 proximate the at least one first engagement member 136. The at least one second engagement member 144 may be configured to engage the at least one first engagement member 136. In the exemplary embodiment shown in FIG. 1, the grip 110 includes arm 130, and the second end 134 of the arm 130 has the at least one first engagement member 136 coupled thereto.

In any embodiment, when the at least one second engagement member 144 is engaged with the at least one first engagement member 136, the pivot unit 140 may be in the inhibited state. When the at least one second engagement member 144 is disengaged from the at least one first engagement member 136, the pivot unit 140 may be in the uninhibited state. In this way, the grip 110 may be freely pivotable in both the first direction and the second direction when under the control of the user, but may be movable in the first direction only when not grasped or once released by the user, preventing uncontrolled upswing of the grip 110, such as during a rapid descent.

Figure 3A:
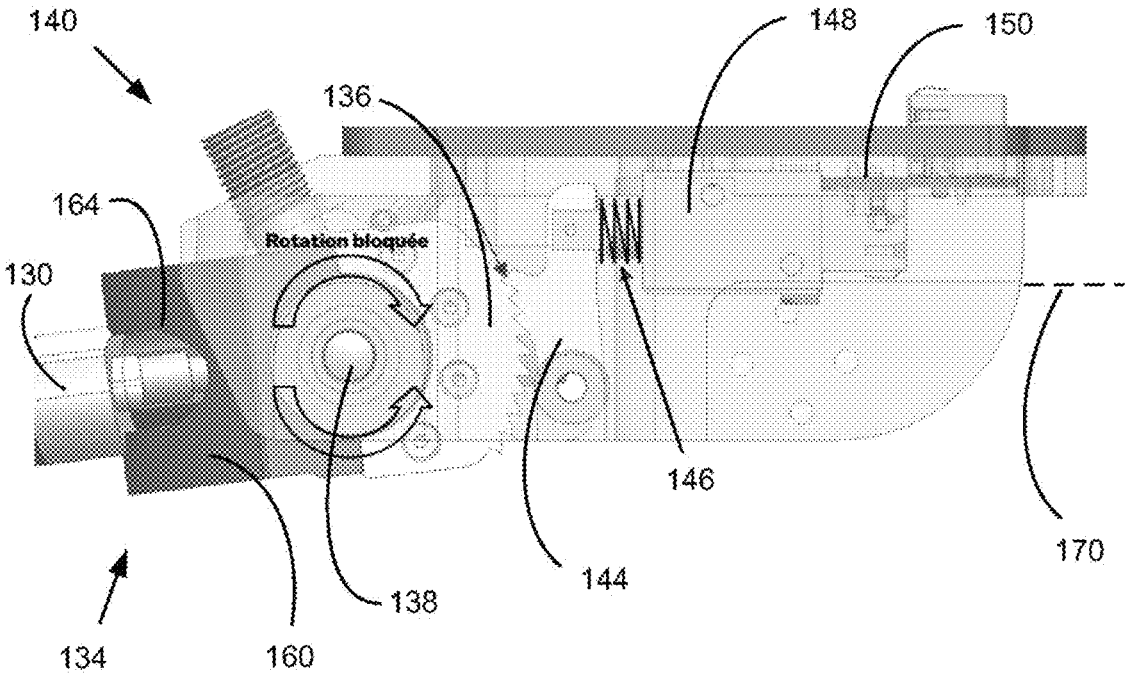
FIG. 3A is a close-up side view of the pivot unit of FIG. 1 in the inhibited state.
Figure 3B:
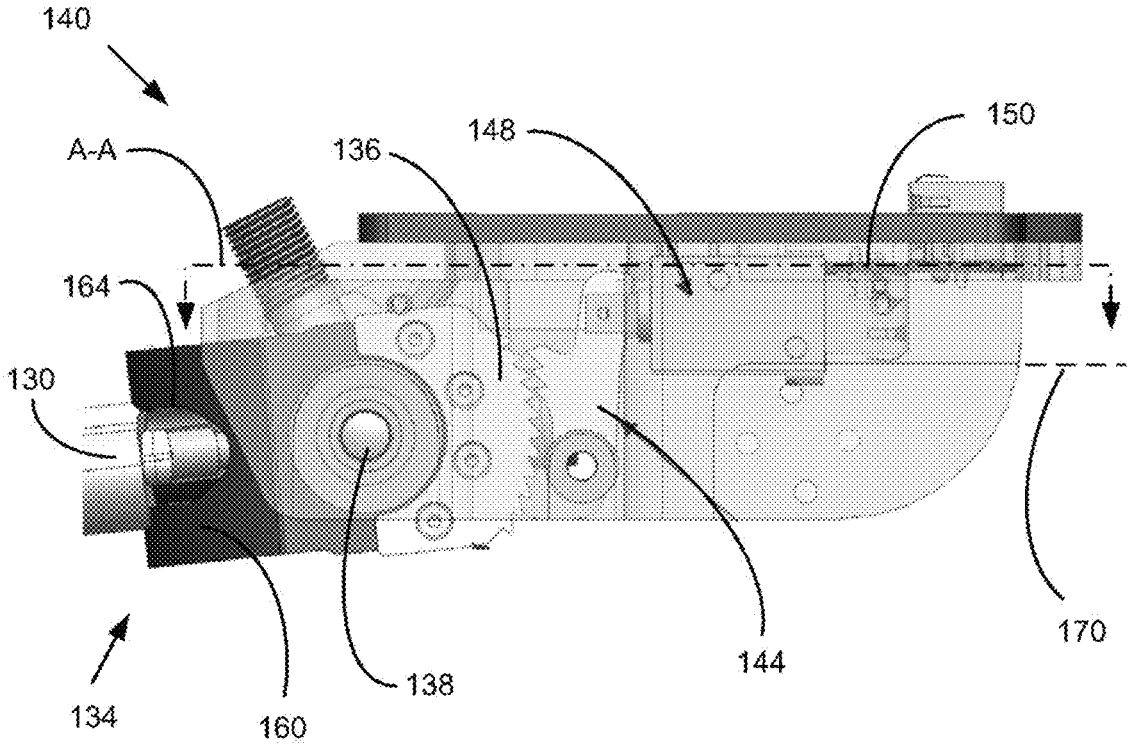
FIG. 3B is a close-up side view of the pivot unit of FIG. 1 in the uninhibited state.

For example, referring now to FIGS. 3A and 3B, shown therein are close-up views of the pivot unit 140 in the inhibited state and the uninhibited state, respectively. As shown in FIG. 3A, the at least one second engagement member 144 is engaged with the at least one first engagement member 136 when the pivot unit 140 is in the inhibited state. As shown in FIG. 3B, the at least one second engagement member 144 is disengaged from the at least one first engagement member 136 when the pivot unit 140 is in the uninhibited state.

In any embodiment, such as the embodiment shown in FIGS. 3A and 3B, each first engagement member 136 may be a ratchet and each second engagement member 144 may be a pawl. Accordingly, in the inhibited state shown in FIG. 3A wherein the second engagement member 144 is engaged with the first engagement member 136, the grip 110 may only pivot in the first direction (i.e., following the counter-clockwise arrow as shown in FIG. 3A). The interlocking of the teeth of the ratchet and pawl permit rotation in the first direction (away from the user) and inhibit rotation in the second direction (toward the user). Similarly, in the uninhibited state shown in FIG. 3B wherein the second engagement member 144 is disengaged from the first engagement member 136, the grip 110 may pivot in both the first direction and the second direction (i.e., following the counter-clockwise arrow and clockwise arrow as shown in FIG. 3A). Any other configuration may be used, including any other first engagement member 136 and second engagement member 144, that may achieve this result.

Referring to FIG. 3A, the pivot unit 140 may further include at least one biasing means 146 coupled to the at least one second engagement member 144. The biasing means 146 may bias the at least one second engagement member 144 toward the at least one first engagement member 136. The biasing means 146 may be any means suitable to urge the at least one second engagement member 144 into engagement with the at least one first engagement member 136. For example, as shown in FIG. 3A, each biasing means may be a spring.

In any embodiment, as shown in FIGS. 3A and 3B, the pivot unit 140 may further include at least one linear drive device 148 coupled to the at least one second engagement member 144, the at least one linear drive device 148 being operable to move the at least one second engagement member 144 away from the at least one first engagement member 136. In the exemplary embodiment shown, the at least one biasing means 146 is located between the coupling of the at least one linear drive device 148 and the at least one second engagement member 144. The linear drive device 148 may be any means suitable to overcome the force of the biasing means 146 to disengage the at least one second engagement member 144 from the at least one first engagement member 136. For example, as shown in FIGS. 3A and 3B, each linear drive device 148 may be a solenoid. As another example, each linear drive device 148 may be a DC motor.

Figure 4:
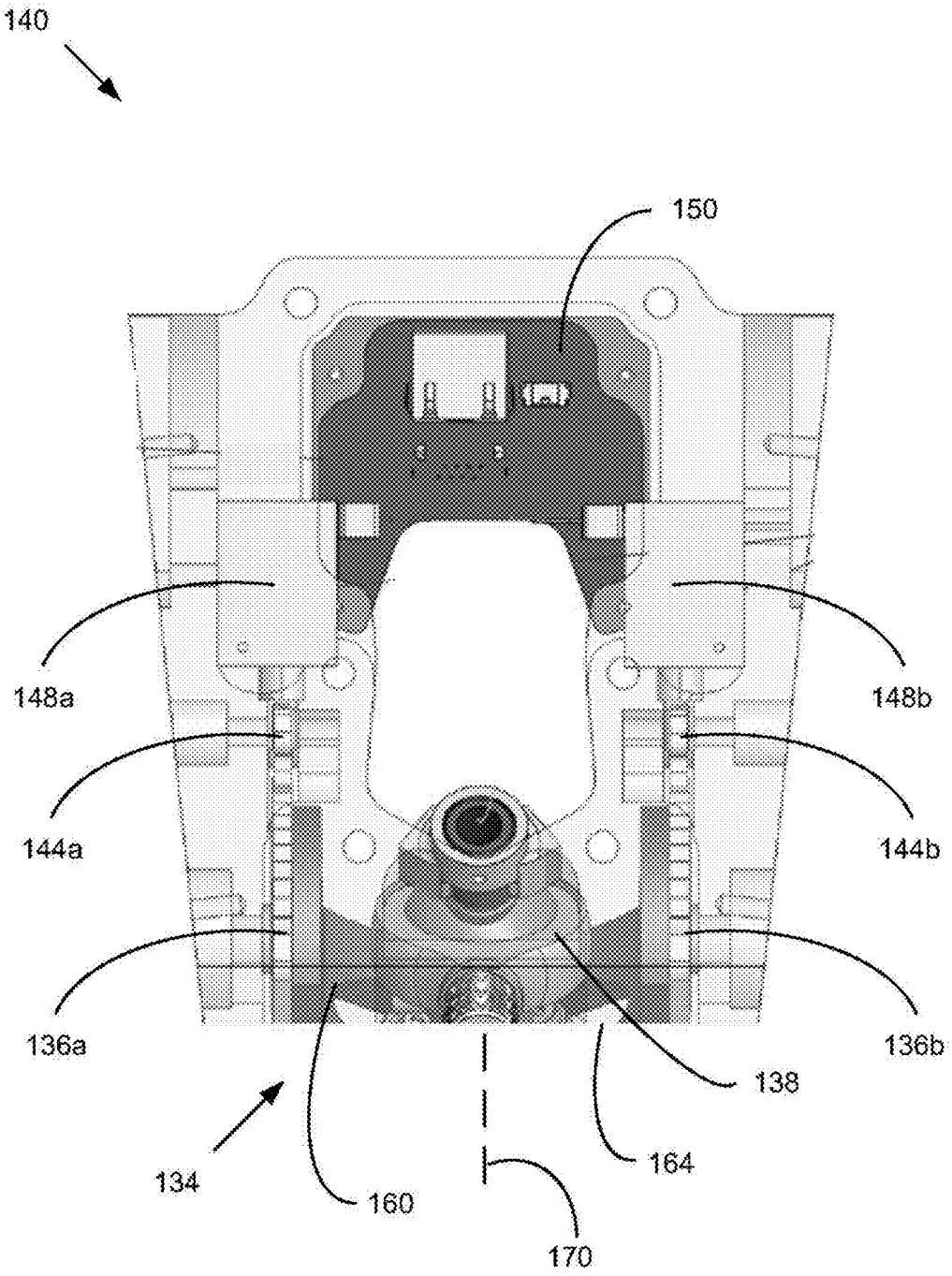
FIG. 4 is a sectional top view of the pivot unit of FIG. 3B along line A-A.

Referring now to FIG. 4, shown therein is a sectional top view of the pivot unit 140 of FIG. 3B along line A-A. In any embodiment, the at least one first engagement member 136 may include at least two first engagement members 136*a*, 136*b*, and the at least one second engagement member 144 may include at least two second engagement members 144*a*, 144*b*, as shown in FIG. 4. The at least one linear drive device 148 may include at least two linear drive devices 148*a*, 148*b*, each linear drive device 148 being operable to move a corresponding second engagement member 144 to disengage from a corresponding first engagement member 136. Similarly, the at least one biasing means 146 may include at least two biasing means (not shown). Any number of first engagement members 136, second engagement members 144, linear drive devices 148, and biasing means 146, are possible. For example, two of each element are present in the exemplary embodiment shown in FIG. 4. As another example, a single linear drive device 148 may be used to simultaneously disengage multiple second engagement members 144 from one or more first engagement members 136. In such examples, a single biasing means 146 or multiple biasing means 146 may urge the second engagement members 144 toward the one or more first engagement members 136.

In any embodiment, the pointer 110 may further include a processor 150 in communication with the grip detection device 120 and the pivot restriction unit 140. As shown in in the exemplary embodiment of FIG. 4, the processor 150 may be located within the pivot restriction unit 140. In alternate embodiments, the processor 150 may be located anywhere within the pointer 100 such as, for example, in the grip 110 or the arm 130. In further alternate embodiments, the processor 150 may be located external to the pointer 100 such as, for example, in the corresponding safety bar, individual cart, or elsewhere in the amusement park ride such as an amusement park ride control station.

In any embodiment, the processor 150 may be configured to operate the pivot unit 140 to transition to the uninhibited state when the grip detection device 120 detects the grip 110 is held by the user. In some embodiments, such as where the processor 150 is located external to the pointer 100, the processor 150 may be configured to operate more than one pivot unit 140 such as, for example, each pivot unit 140 of each pointer 100 located in the corresponding individual cart or each pivot unit 140 of each pointer 100 located on the amusement park ride.

Operating the pivot unit 140 to transition to the uninhibited state may involve activating the at least one linear drive device 148 to move the at least one second engagement member 144 to disengage from the at least one first engagement member 136. In the embodiment shown in FIG. 4, the linear drive devices 148*a*, 148*b* are solenoids. Accordingly, in such embodiments, the processor 150 may be configured to energize the solenoids to move a movable core of the solenoids that may be coupled to the second engagement members 144*a*, 144*b*, and thereby move the second engagement members 144*a*, 144*b* to disengage from the first engagement members 136*a*, 136*b*.

The processor 150 may further be configured to operate the pivot unit 140 to return to the inhibited state when the grip detection device 120 detects the grip 110 is released. Operating the pivot unit 140 to return to the inhibited state may include deactivating the at least one linear drive device 148 such that the at least one biasing means 146 returns the at least one second engagement member 144 into engagement with the at least one first engagement member 136. Referring again to the exemplary embodiment shown in FIG. 4, the linear drive devices 148*a*, 148*b* are solenoids, and the processor 150 may therefore be configured to de-energize the solenoids to remove the pulling force on the movable core of the solenoid, thereby allowing the second engagement members 144*a*, 144*b* to be returned into engagement with the first engagement members 136*a*, 136*b* under force of the biasing means 146*a*, 146*b*.

The at least one linear drive device 148 may be any other means suitable for disengaging the at least one second engagement member 144 from the at least one first engagement member 136. For example, the at least one linear drive device 148 may be a DC motor coupled to the at least one second engagement member 144. In such examples, the processor 150 may be configured to operate the DC motor to move the at least one second engagement member 144 both to engage and disengage the at least one first engagement member 136. Where a linear drive device 148 such as a DC motor is used to move the at least one second engagement member 144 in both directions, a biasing means 146 may not be needed.

Figure 2:
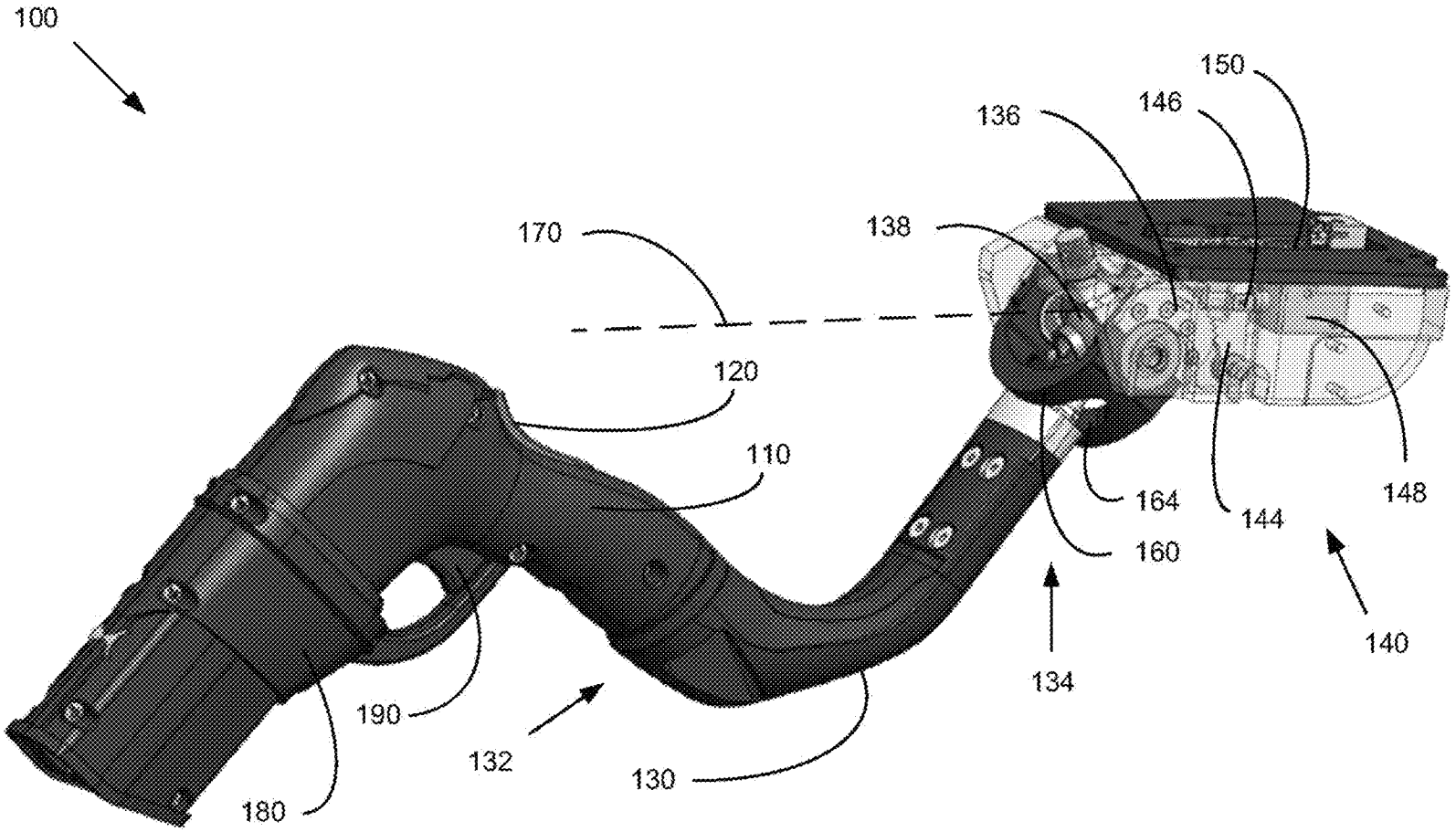
FIG. 2 is a side perspective view of the pointer of FIG. 1.

In some embodiments, the grip 110 may be pivotable between a lower position in the first direction (away from the user) and an upper position in the second direction (toward the user). Referring to FIG. 2, shown therein is the grip 110 in the lower position. As shown, the lower position may be 30-degrees in the first direction from a longitudinal axis 170 of the pivot unit 140. The upper position may similarly be 30-degrees in the second direction from the longitudinal axis 170 of the pivot unit 140.

The longitudinal axis 170 of the pivot unit 140 may define a Z-axis in a Cartesian coordinate system, and the upper position and the lower position may further define a Y-axis (exemplary axis shown in FIG. 6). Accordingly, in the embodiment shown in FIG. 2 the grip 110 has a 60-degree range of motion in the up-down direction relative to the longitudinal axis 170 of the pivot unit 140 (i.e., in the Y-direction). Any other range of motion, with any other defined upper position and lower position, may be used. The range of motion, upper position, and lower position may depend, for example, on the requirements of the particular amusement park ride, or the portion thereof, to which the pointer 100 is mounted.

Accordingly, in any embodiment, when the at least one second engagement member 144 is engaged with the at least one first engagement member 136 and the grip 110 is in the lower position, the grip 110 may be inhibited from moving in the Y-direction. That is, the lower position may define the furthest extent of rotation in the first direction of the grip 110 and the at least one second engagement member 144 may prevent rotation in the second direction, thus inhibiting movement in both the first direction and the second direction.

In some embodiments, when the user releases the grip 110, the grip 110 may automatically move to the lower position. For example, the grip 110 may be biased in the first direction toward the lower position such that the grip 110 moves in the first direction to the lower position when released by the user. As another example, the grip 110 may be balanced such that the grip 110 falls in the first direction to the lower position under the force of gravity when released by the user. In this way, the grip 110 may automatically become positioned out of harm's way, protecting the pointer 100 from damage and protecting the user from risk of injury.

It may be understood that the grip 110 may not return to the lower position until released by the user. That is, in the use case where the user has released the grip detection device 120 but maintains a hold of the grip 110 or the arm 130 of the pointer 100, the pivot unit 140 may be in the inhibited state such that the user may not rotate the grip 110 in the second direction. Accordingly, in such a scenario, the user may only move the grip 110 in the first direction until reaching the lower position and may be unable to return in the second direction until re-engaging the grip detection device 120.

The grip 110 may further include a ball joint 138 pivotably coupling the grip 110 to the pivot unit 140. In the exemplary embodiment shown in FIG. 2, the grip 110 includes an arm 130, and the ball joint 138 is located at the second end 134 of the arm 130. In any embodiment, the ball joint 138 may permit the grip 110 to pivot in at least a third direction and a fourth direction. The third direction and the fourth direction may respectively be a leftward direction and a rightward direction from to the longitudinal axis 170 of the pivot unit 140. The third direction and the fourth direction may define an X-axis in the Cartesian coordinate system, an example of which is shown in FIG. 6.

In any embodiment, the pointer 100 may further include a jaw 160 surrounding the ball joint 138, the jaw 160 coupled to the at least one first engagement member 136 such that the jaw 160 rotates with the grip 110 when pivoting in the first direction and the second direction. In the embodiment shown in FIG. 2, the jaw 160 is roughly "U" shaped, with one first engagement member 136 coupled to each leg of the "U". Accordingly, the jaw 160 and the first engagement members 136 may move in unison when the grip 110 pivots in the first direction or the second direction.

In any embodiment, the jaw 160 may further include a lateral slot 164 and the grip 110, or the second end 134 of the arm 130, where used, may extend through the lateral slot 164 to the ball joint 138. The lateral slot 164 may define a boundary within which the grip 110 may be pivotable in the third direction and the fourth direction (i.e., the X-direction). Referring again to FIG. 4, shown therein is a top cross-sectional view of the pivot unit 140 with the jaw 160 surrounding the ball joint 138. In the exemplary embodiment shown, the lateral slot 164 may permit the grip 110 to pivot up to 30-degrees in the third direction and up to 30-degrees in the fourth direction from the longitudinal axis 170 of the pivot unit 140. Accordingly, in the embodiment shown in FIG. 4 the grip 110 has a 60-degree range of motion in the left-right direction (i.e., X-direction) relative to the longitudinal axis 170 of the pivot unit 140 (i.e., the Z-axis). Any other range of motion may be used depending on, for example, the requirements of the particular amusement park ride, or the portion thereof, to which the pointer 100 is mounted.

Figure 7:
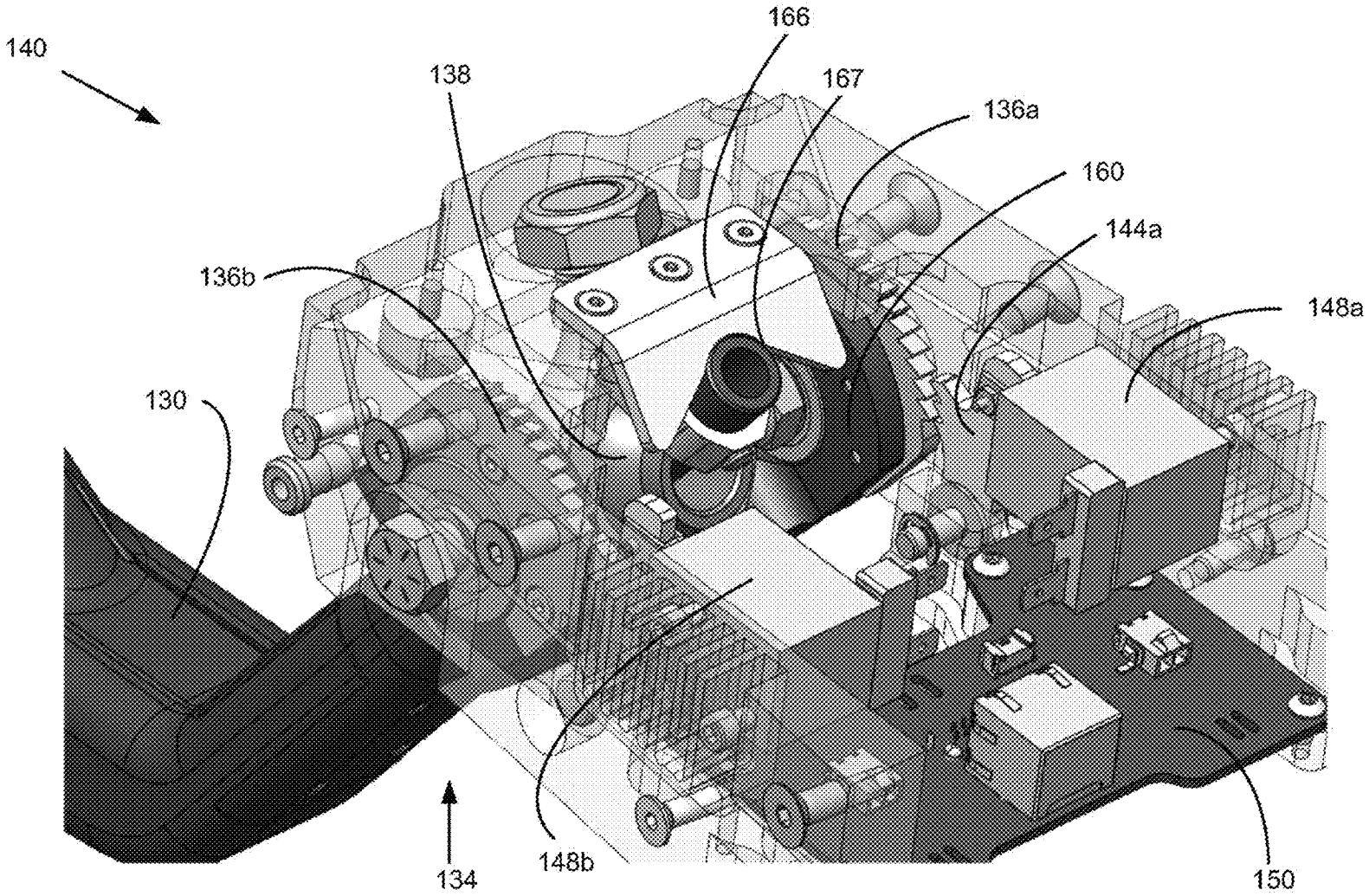
FIG. 7 is a rear perspective view of the pivot unit of FIG. 1.

Referring now to FIG. 7, the pivot unit 140 may further include a lateral stop 166. The lateral stop 166 may be coupled to the pivot unit 140 proximate the ball joint 138 such that, when the grip 110 is in the lower position, the second end 134 of the arm 130 (or the grip 110, where no arm 130 is used), contacts the lateral stop 166. The lateral stop 166 may have a recessed portion 167 shaped to receive the second end 134 of the arm 130 or the grip 110 such that, once received, movement of the grip 110 in the third direction and the fourth direction may be inhibited (i.e., in the X-direction).

In the exemplary embodiment shown, the lateral stop 166 has a V-shaped recessed portion 167 such that, as the grip 110 rotates in the first direction toward the lower position, the recessed portion 167 of the lateral stop 166 may guide the grip 110 to be centered in front of the user. The V-shaped recessed portion 167 of the lateral stop 166 may prevent the grip 110 from pivoting in the third direction or the fourth direction without also rotating in the second direction (toward the user). Accordingly, when the pivot unit 140 is in the inhibited state and the grip 110 is in the lower position, the grip 110 is inhibited from pivoting (i.e., in the X-direction and the Y-direction).

Other shapes of the recessed portion 167 of the lateral stop 166 suitable for inhibiting pivoting in the third direction and the fourth direction when the grip 110 is in the lower position are possible. For example, the lateral stop 166 may have a U-shaped or parabolically shaped recessed portion 167.

The width of the lateral stop 166 and the recessed portion 167 may further be selected to match or exceed the range of motion of the grip 110 in the X-direction such that the lateral stop 166 may catch the second end 134 of the arm 130 or the grip 110 anywhere within the range of motion such that the recessed portion 167 may guide the grip 110 to be centered in front of the user. Alternately, the recessed portion 167 may be shaped to match the second end 134 of the arm 130 or the grip 110 such that the second end 134 of the arm 130 or the grip 110 may be first aligned with the recessed portion 167 before advancing further in the first direction to the lower position.

Figure 5:
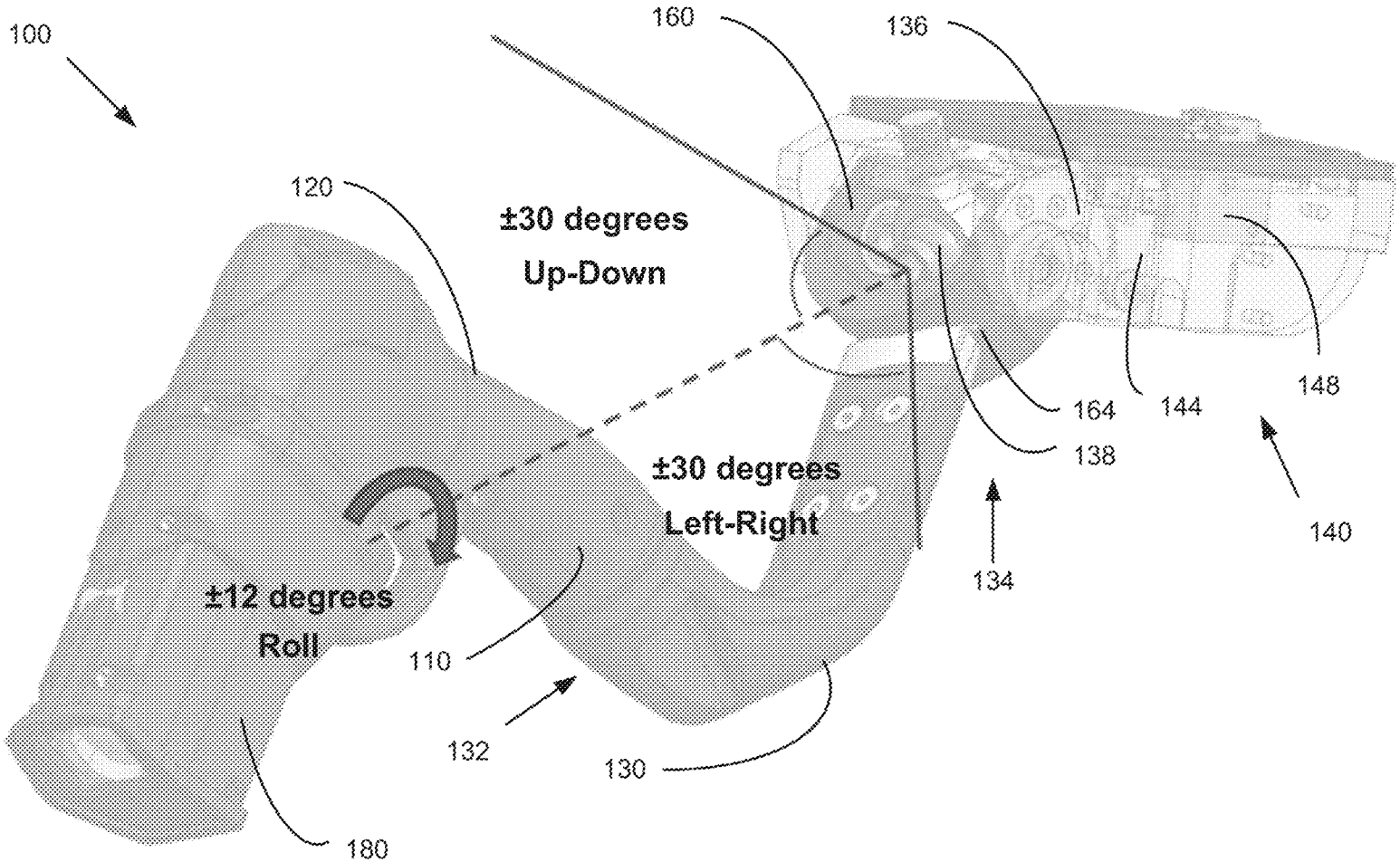
FIG. 5 is a perspective side view of the pointer of FIG. 1 with lines indicating range of motion when the pivot unit is in the uninhibited state.

In any embodiment, the lateral slot 164 may define a rotational boundary within which the grip 110 is rotatable about the ball joint 138. For example, the grip 110 or arm 130, where used, may rotate within the lateral slot 164 about the ball joint 138 until contact with the edges of the lateral slot 164 prevent further rotation. Referring now to FIG. 5, shown therein is the pointer 100 with lines indicating an exemplary range of motion in the first direction, the second direction, the third direction, the fourth direction, and rotationally about the ball joint 138. In the embodiment shown, the rotational boundary within the lateral slot 164 of the jaw 160 may permit the grip 110 to rotate up to 12 degrees in a clockwise direction and up to 12 degrees in a counterclockwise direction about the ball joint 138. Any other range of rotational motion may be used depending on, for example, the requirements of the particular amusement park ride, or the portion thereof, to which the pointer 100 is mounted.

Figure 8:
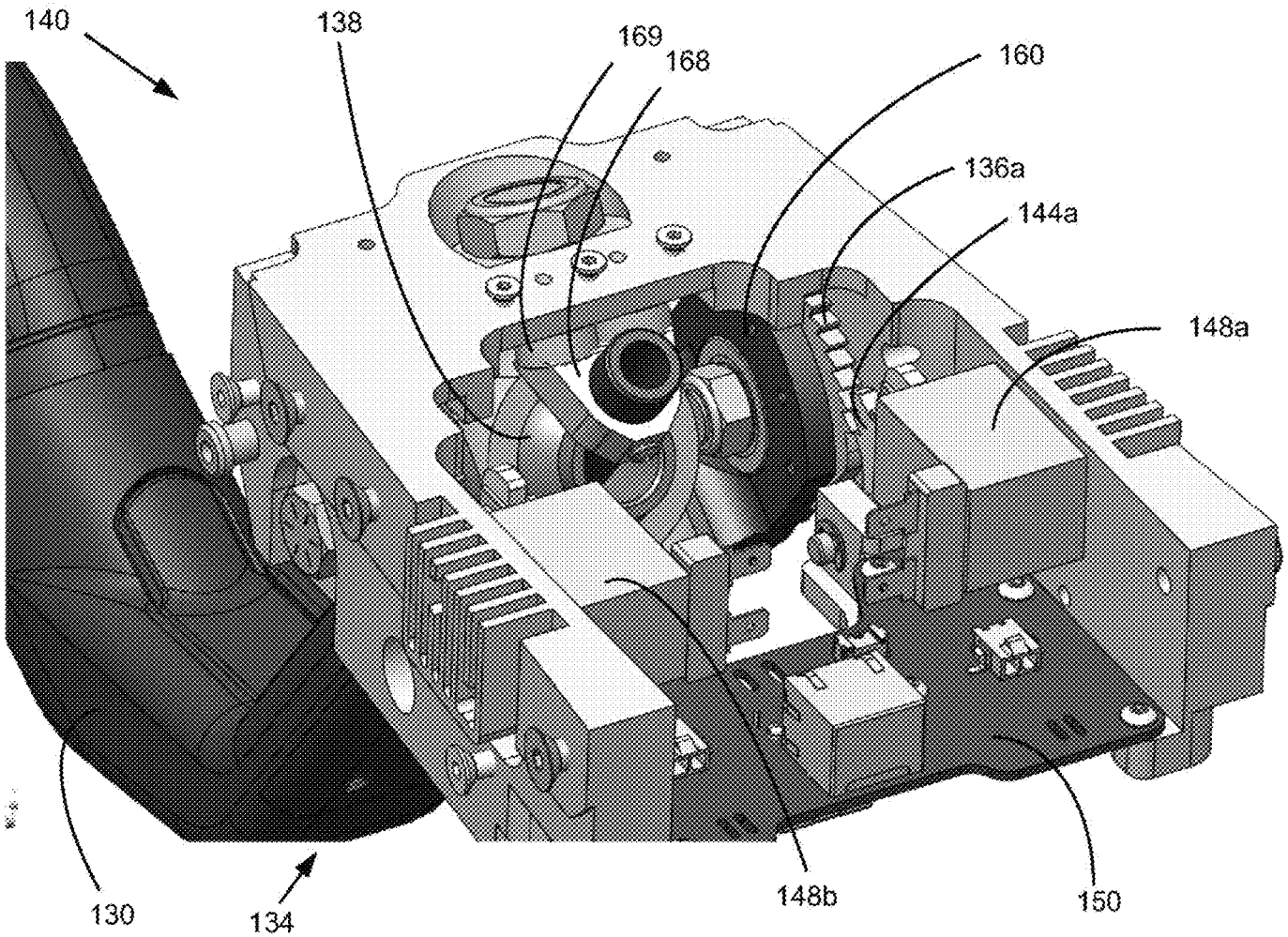
FIG. 8 is a rear perspective view of the pivot unit of FIG. 1 with the lateral block removed.

Referring now to FIG. 8, the grip 110 may further include a rotational stop 168 configured to prevent rotation of the grip 110 when in the lower position. For example, in the embodiment shown, the rotational stop 168 is a collar coupled to the second end 134 of the arm 130 or grip 110, where no arm is used. In the example shown, the rotational stop 168 has a flat portion (not shown) shaped to contact a stop member 169 which, as shown, may be a bolt or a pin. In some embodiments, the recessed portion 167 of the lateral stop 166 (omitted from FIG. 8), where used, may guide the rotational stop 168 into contact with stop member 169 as the grip 110 moves toward the lower position. Contact between the rotational stop 168 and stop member 169 may prevent rotation of the grip 110 about the ball joint 138. In some embodiments, the stop member 169 may be an upper surface of the pivot unit 140 and the rotational stop 168 may thus be shaped to contact the upper surface of the pivot unit 140.

According to some embodiments, one of the rotational stop 168 and the stop member 169 as described above may be shaped to receive the other of the rotational stop 168 and the stop member 169 such that, when received, rotation of the grip 110 about the ball joint 138 is inhibited. In such embodiments, the recessed portion 167 of the lateral stop 166 may guide the rotational stop 168 into engagement with the stop member 169 (i.e., align the male-female mating connection).

In some embodiments, the rotational stop 168 may be a recess or slot in the second end 134 of the arm 130 or the grip 110, shaped to receive the stop member 169. In some embodiments, the stop member 169 may be a recess or slot in the upper surface of the pivot unit 140 shaped to receive the rotational stop 168. In such embodiments, the recessed portion 167 of the lateral stop 166 may guide the rotational stop 168 into engagement with the stop member 169 (i.e., align the male-female mating connection).

Accordingly, as described above, when the pivot unit 140 is in the inhibited position, the grip 110 is in the lower position, and where the lateral stop 166 and the rotational stop 168 are used, the grip 110 may be inhibited from moving in the first direction and the second direction (i.e., the Y-direction), the third direction and the fourth direction (i.e., the X-direction), and rotationally about the ball joint 138. In some embodiments, where it may be desirable to permit some motion of the grip 110 when in the lower position, one, both, or neither of the lateral stop 166 and the rotational stop 168 may be used.

In any embodiment, the pointer 100 may further include a barrel 180 extending from the grip 110. The barrel 180 may assist the user in directing the grip 110 toward a target and may be the source from which the "shot" emanates. In any embodiment, the grip 110 may further comprise a trigger 190, the trigger 190 being depressible by a finger of the hand of the user to initiate the "shot". For example, the user may depress the trigger 190 to initiate a single "shot" or may maintain the trigger 190 in a depressed state for a continuous "shot".

Referring again to FIG. 1, the grip 110, barrel 180, and trigger 190 are configured to resemble that of a single hand-held firearm. Accordingly, the user may grasp the grip 110 and engage the grip detecting device 120, at which time the processor may transition the pivot unit 140 to the uninhibited state. The user may then direct the grip 110 within the range of motion of the grip 110, using the barrel 180 as a guide to direct the "shot". Upon taking aim at the desired target, the user may depress the trigger 190 to initiate the "shot". Other configurations, such as pointers resembling other weaponry both real and imaginary, are possible.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A pointer for mounting on an amusement park ride, the pointer comprising:

a grip adapted to be held by at least one hand of a user;

a grip detection device integrated into the grip, the grip detection device for detecting when the grip is held by the user; and a pivot unit pivotably coupling the grip to at least one portion of the amusement park ride, the pivot unit operable between an uninhibited state, in which the pivot unit permits the grip to freely pivot in at least a first direction and a second direction, and an inhibited state, in which the pivot unit inhibits the grip from pivoting in at least the second direction;

wherein the pivot unit transitions to the uninhibited state when the grip detection device detects the grip is held by the user; and wherein the pivot unit returns to the inhibited state when the grip detection device detects the grip is released.

2. The pointer of claim 1, wherein the first direction is away from the user and the second direction is toward the user.

3. The pointer of claim 1, wherein the grip comprises at least one first engagement member coupled to the grip proximate the pivot unit, and the pivot unit comprises at least one second engagement member movably coupled to the pivot unit, the at least one second engagement member for engaging the at least one first engagement member;

wherein when the at least one second engagement member is engaged with the at least one first engagement member, the pivot unit is in the inhibited state; and wherein when the at least one second engagement member is disengaged from the at least one first engagement member, the pivot unit is in the uninhibited state.

4. The pointer of claim 3, wherein the grip further comprises an arm extending from a first end to a second end, the first end extending from the grip, the second end being pivotably coupled to the at least one portion of the amusement park ride via the pivot unit;

wherein the second end of the arm comprises the at least one first engagement member.

5. The pointer of claim 3, wherein the pivot unit further comprises at least one biasing means coupled to the at least one second engagement member, the biasing means biasing the at least one second engagement member toward the at least one first engagement member.

6. The pointer of claim 5, wherein the pivot unit further comprises at least one linear drive device coupled to the at least one second engagement member, the at least one linear drive device being operable to move the at least one second engagement member to disengage from the at least one first engagement member.

7. The pointer of claim 6, wherein the at least one first engagement member comprises at least two first engagement members, and the at least one second engagement member comprises at least two second engagement members.

8. The pointer of claim 7, wherein the at least one biasing means comprises at least two biasing means, and the at least one linear drive device comprises at least two linear drive devices.

9. The pointer of claim 3, wherein each first engagement member comprises a ratchet and each second engagement member comprises a pawl.

10. The pointer of claim 5, wherein each biasing means comprises a spring.

11. The pointer of claim 6, wherein each linear drive device comprises a solenoid.

12. The pointer of claim 6, further comprising a processor in communication with the grip detection device and the pivot unit configured to:

operate the pivot unit to transition to the uninhibited state when the grip detection device detects the grip is held by the user; and operate the pivot unit to return to the inhibited state when the grip detection device detects the grip is released.

13. The pointer of claim 12, wherein operating the pivot unit to transition to the uninhibited state comprises activating the at least one linear drive device to move the at least one second engagement member to disengage from the at least one first engagement member; and wherein operating the pivot unit to return to the inhibited state comprises deactivating the at least one linear drive device such that the at least one biasing means returns the at least one second engagement member into engagement with the at least one first engagement member.

14. The pointer of claim 1, wherein the grip detection device comprises a depressible member, and the grip detection device detects the grip is held by the user when the depressible member is depressed by the hand of the user.

15. The pointer of claim 14, wherein the depressible member is a button.

16. The pointer of claim 14, wherein the depressible member is a switch.

17. The pointer of claim 1, wherein the grip detection device comprises a touch sensor, and the grip detection device detects the grip is held by the user when the hand of the user contacts the touch sensor.

18. The pointer of claim 2, wherein the grip is pivotable between a lower position in the first direction and an upper position in the second direction.

19. The pointer of claim 18, wherein when the at least one second engagement member is engaged with the at least one first engagement member and the grip is in the lower position, the pointer is inhibited from moving.

20. The pointer of claim 1, wherein the at least one portion of the amusement park ride comprises a safety bar, and the grip is pivotably coupled to the safety bar via the pivot restriction unit such that the grip is positioned in front of the user when seated on the amusement park ride.

21. The pointer of claim 18, wherein the upper position is 30 degrees rotationally in the second direction from a longitudinal axis of the pivot unit.

22. The pointer of claim 21, wherein the lower position is 30 degrees rotationally in the first direction from the longitudinal axis of the pivot unit.

23. The pointer of claim 18, wherein the grip further comprises a ball joint pivotably coupling the grip to the pivot unit, the ball joint permitting the grip to pivot in at least a third direction and a fourth direction, the ball joint further permitting the grip to rotate about the ball joint in a clockwise direction and a counter-clockwise direction.

24. The pointer of claim 23, wherein the pivot unit further comprises a lateral stop coupled to the pivot unit proximate the ball joint, the lateral stop having a recessed portion shaped to receive the grip when the grip is in the lower position;

wherein when the grip is received in the recessed portion, the grip is inhibited from pivoting in the third direction and the fourth direction.

25. The pointer of claim 24, wherein the recessed portion of the lateral stop is further shaped to guide the grip to be centered in front of the user when moving to the lower position.

26. The pointer of claim 23, wherein the grip further comprises a rotational stop coupled to the grip proximate the ball joint and the pivot unit further comprises a stop member proximate the ball joint, the rotational stop being shaped to engage the stop member when the grip is in the lower position;

wherein when the rotational stop is engaged with the stop member, the grip is inhibited from rotating about the ball joint in the clockwise direction and the counter-clockwise direction.

27. The pointer of claim 23, further comprising a jaw coupled to the at least one first engagement member, the jaw surrounding the ball joint such that the jaw moves with the grip when pivoting in the first direction and the second direction.

28. The pointer of claim 27, wherein the jaw further comprises a lateral slot and the grip extends through the lateral slot, the lateral slot defining a boundary within which the grip is pivotable in the third direction and the fourth direction.

29. The pointer of claim 28, wherein the boundary of the lateral slot permits the grip to pivot up to 30 degrees in the third direction and up to 30 degrees in the fourth direction, the third direction being leftward from the longitudinal axis of the pivot unit, the fourth direction being rightward from the longitudinal axis of the pivot unit.

30. The pointer of claim 27, wherein the lateral slot defines a rotational boundary within which the grip is rotatable about the ball joint.

31. The pointer of claim 30, wherein the rotational boundary permits the grip to rotate up to 12 degrees in a clockwise direction and up to 12 degrees in a counter-clockwise direction about the ball joint.

32. The pointer of claim 18, wherein the grip is balanced such that the grip falls in the first direction to the lower position when released by the user.

33. A pointer for mounting on an amusement park ride, the pointer comprising:

a grip adapted to be held by at least one hand of a user, the grip being adapted to be coupled to at least a portion of the amusement park ride;

a grip detection device integrated into the grip, the grip detection device for detecting when the grip is held by the user; and a pivot unit located between the grip and the at least one portion of the amusement park ride, the pivot unit permitting the user to freely pivot the grip about at least one axis when the grip detection device detects the grip is held by the user;

wherein the pivot unit is further adapted to bias the grip away from the user and to prevent pivoting of the grip when the grip detection device is released.

* * * * *